US007406794B1

(12) United States Patent
Pope, Jr.

(10) Patent No.: US 7,406,794 B1
(45) Date of Patent: Aug. 5, 2008

(54) RIFLE VISE

(76) Inventor: Nehemiah Pope, Jr., 620 Snell Rd., P.O. Box 840, Columbia, NC (US) 27925

( * ) Notice: Subject to any disclaimer, the term of this patent is extended or adjusted under 35 U.S.C. 154(b) by 62 days.

(21) Appl. No.: 11/460,106

(22) Filed: Jul. 26, 2006

(51) Int. Cl.
*F41A 23/06* (2006.01)

(52) U.S. Cl. ..... 42/94; 89/37.04

(58) Field of Classification Search ..... 42/94; 89/37.04
See application file for complete search history.

(56) References Cited

U.S. PATENT DOCUMENTS 3,225,656 A * 12/1965 Flaherty et al. ..... 89/37.04
3,358,504 A * 12/1967 Freebairn ..... 73/167
3,827,172 A * 8/1974 Howe ..... 42/94
4,055,017 A * 10/1977 Thompson ..... 42/94
4,548,392 A * 10/1985 Rickling ..... 269/156
4,998,944 A * 3/1991 Lund ..... 42/94
5,056,410 A * 10/1991 Pitts ..... 89/37.04
5,070,636 A * 12/1991 Mueller ..... 42/94
5,081,782 A * 1/1992 Wright ..... 42/94
5,419,233 A * 5/1995 Mulvaney ..... 89/37.04
5,497,575 A * 3/1996 Fried ..... 42/94
5,666,757 A * 9/1997 Helmstadter ..... 42/94
5,811,720 A * 9/1998 Quinnell et al. ..... 89/37.04
6,338,218 B1 * 1/2002 Hegler ..... 42/94
6,526,687 B1 * 3/2003 Looney ..... 42/94
7,086,192 B2 * 8/2006 Deros ..... 42/94

* cited by examiner

*Primary Examiner*—Bret Hayes
(74) *Attorney, Agent, or Firm*—John F. Bohland

(57) ABSTRACT

A portable rifle vise usable from a standing, sitting, or prone position is disclosed. The device is easily disassembled for storage or transportation.

5 Claims, 7 Drawing Sheets

RIFLE VISE

BACKGROUND

The present invention relates to devices for holding a rifle steady while a shot is fired. More particularly, the present invention relates to devices to aid in zeroing the sights of a rifle.

Ideally, after a bullet leaves the muzzle of a rifle, it strikes the target at the precise point that was in the rifle sights at the time the trigger was pulled. However, in practice, there are many factors that adversely affect the accuracy of the sight adjustment, and the sights need to be periodically zeroed in. In general, the process of zeroing in involves sighting a rifle at a target, firing, observing the difference between the site struck by the bullet and the point at which the rifle was aimed, and adjusting the sights to correct for the error. This process may require several cycles of testing and adjusting to obtain the desired accuracy.

U.S. Pat. No. 5,081,783, incorporated herein by reference, describes a device for supporting and sighting a firearm. This device is described as compact and portable. It is apparently designed to be used on the ground with the operator in a prone position. It could possibly be used on a table with the operator in a sitting position, but the portability feature would be somewhat compromised if a table were required as part of the package.

SUMMARY OF THE INVENTION

It is an object of the present invention to provide a rifle vise that is useful for zeroing sights.

It is a further object of the present invention to provide a rifle vise that is portable.

It also an object of the present invention to provide a rifle vise that can be used with the operator in either a prone, sitting, or standing position.

A rifle vise according to the present invention comprises a stock vise and a butt support on a mounting plate. The mounting plate is adjustably engaged with a support plate. The adjustment between the mounting plate and the support plate is used to aim a rifle held in the vise. Means for absorbing recoil energy is also incorporated between the mounting plate and the support plate. A telescoping vertical support member is removably engaged with the support plate at its upper end and a base plate at its lower end.

DETAILED DESCRIPTION OF A PREFERRED EMBODIMENT

Figure 1:
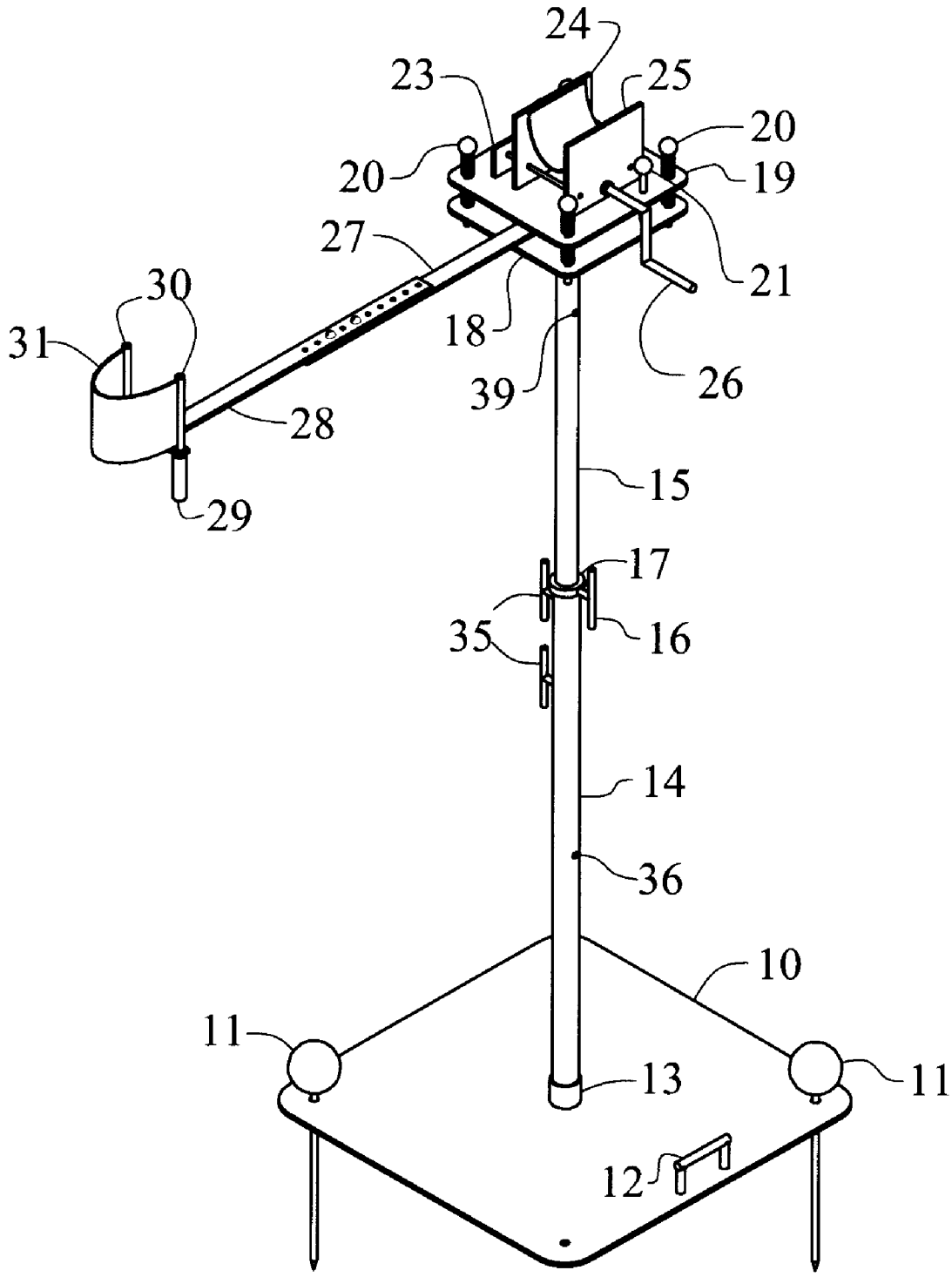
FIG. 1 is an overall view of a rifle vise according to the present invention.
Figure 2:
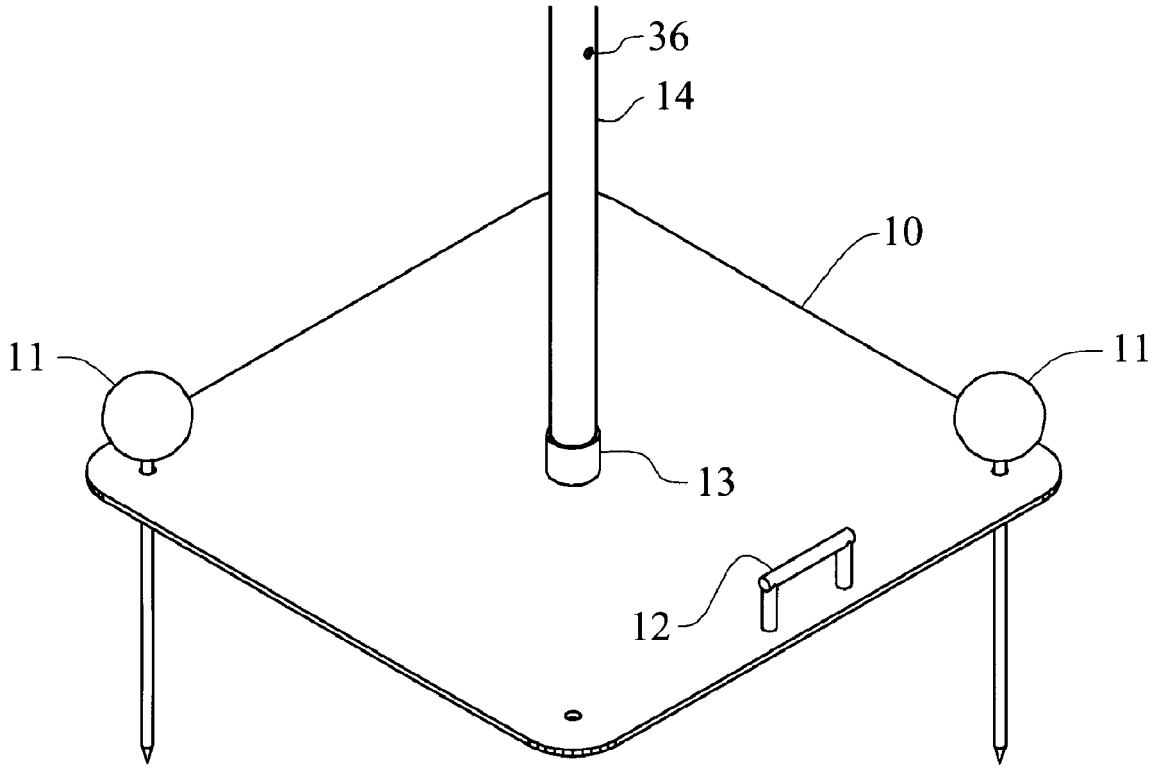
FIG. 2 shows the lower portion of a rifle vise according to the present invention.
Figure 3:
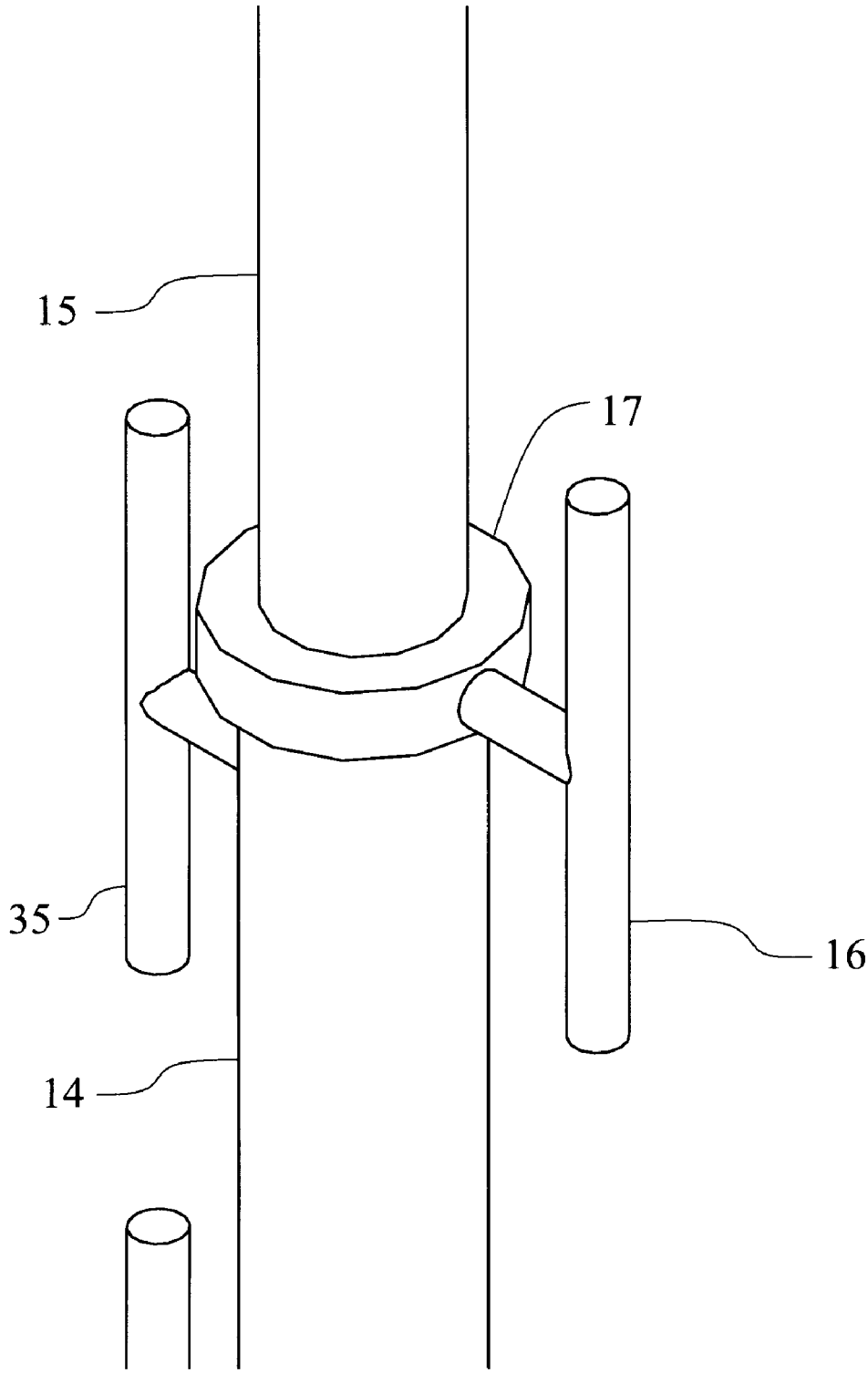
FIG. 3 shows the center portion of the telescoping vertical support member of a rifle vise according to the present invention.
Figure 4:
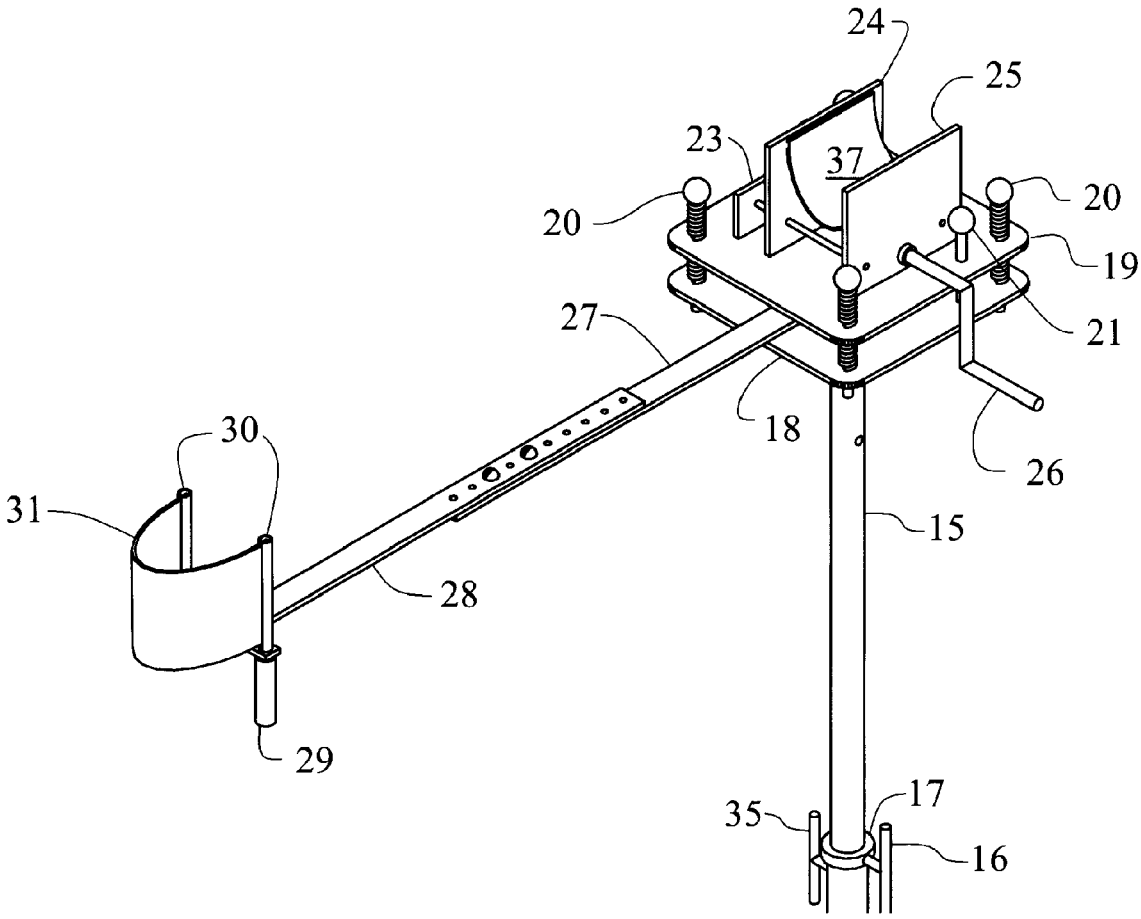
FIG. 4 shows the upper portion of a rifle vise according to the present invention.
Figure 5:
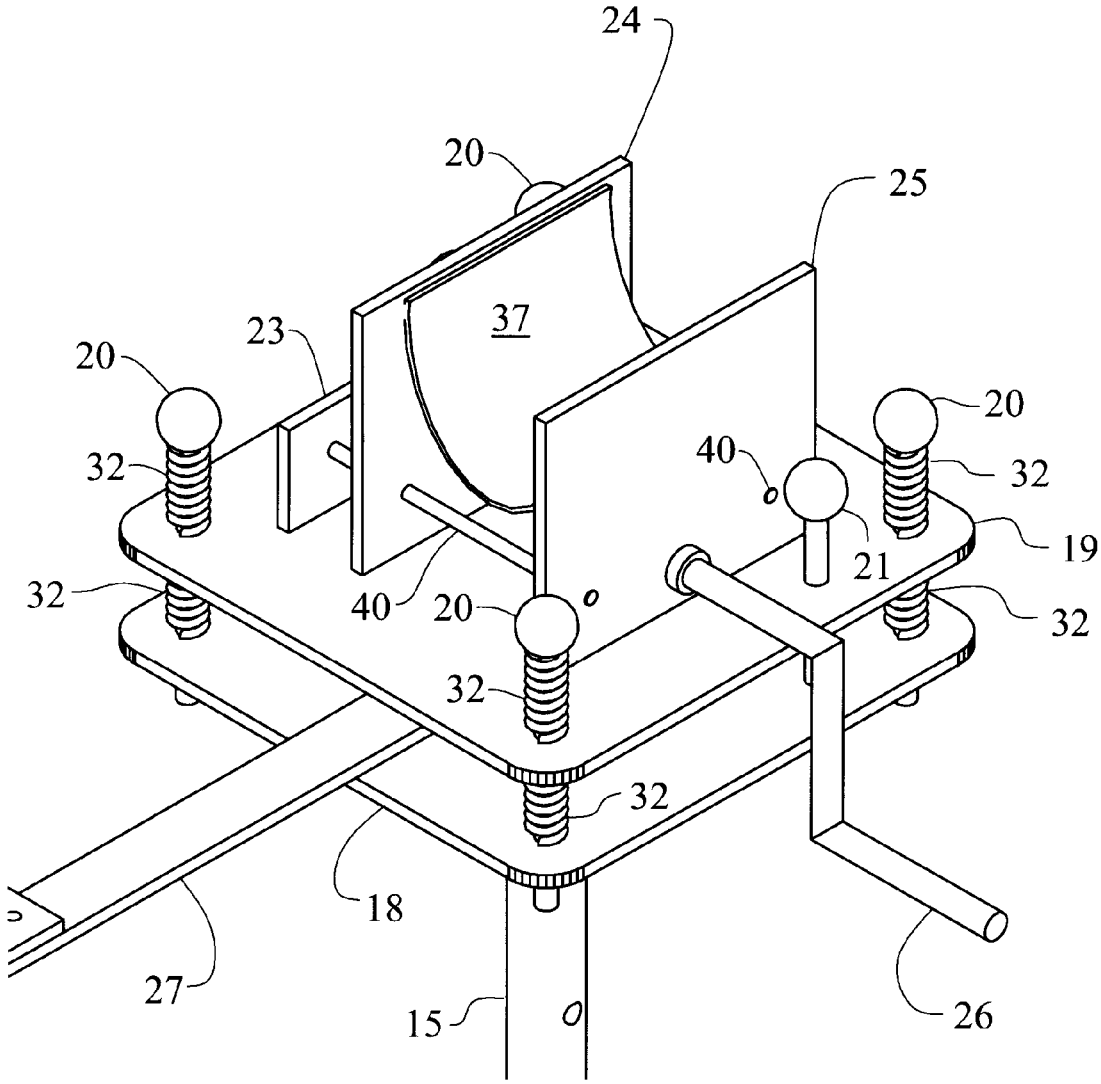
FIG. 5 is an enlarged view of the vise mechanism of a rifle vise according to the present invention.
Figure 6:
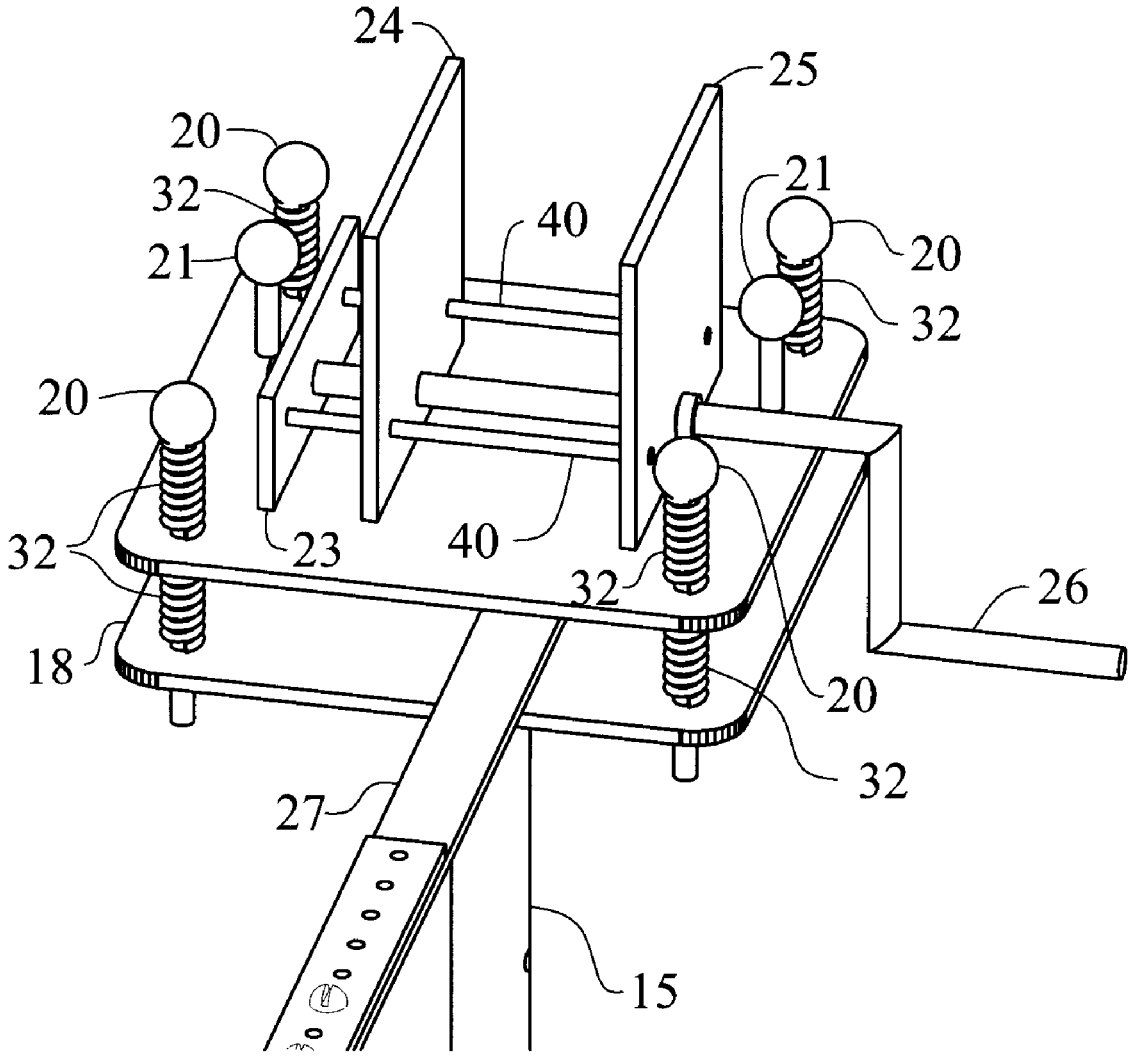
FIG. 6 is an enlarged view of the vise mechanism with the compliant material removed to show additional detail.

A preferred embodiment of a rifle vise according to the present invention is shown in FIGS. 1-7.

Base plate 10 has apertures in its corners to accommodate earth pins 11 that are used to secure the base plate to the earth. Optionally, handle 12 is provided to enhance portability. Coupling 13 is fixed to the base plate and provides means for engaging the lower section 14 of an elongated telescoping vertical support member. In a preferred embodiment, coupling 13 is threaded to accommodate a threaded end on the lower section of the telescoping vertical member.

The telescoping vertical support member comprises a lower section 14 and an upper section 15. Collar 17 with T-handle screw 16 is clamped on upper section 15 to set the total height of the telescoping vertical support member. T-handle screws 35 pass through threaded apertures in the lower section 14 and clamp the upper section 15, thereby enhancing the rigidity and stability of the telescoping vertical support member. In the preferred embodiment, the lower section 14 has an aperture 36 into which an earth pin 11 may be inserted to provide leverage to aid in screwing the lower section into and out of coupling 13. Similarly, upper section 15 has an aperture 39 to accommodate an earth pin to facilitate screwing the upper section into and out of support plate 18.

Mounting plate 19 is adjustably engaged with support plate 18. In a preferred embodiment, the means for adjustable engagement comprises springs and threaded pins, including four corner pins 20, two middle pins 21, and eight springs 32. Middle pins 21 are engaged with threaded apertures in mounting plate 19 and bear on the surface of support plate 18. Corner pins 20 are engaged with threaded apertures in support plate 18, but they pass freely through unthreaded apertures in mounting plate 19.

A rifle vise mechanism on mounting plate 19 comprises two vertical plates, 23 and 25, fixed to the mounting plate by welding or other means and movable plate 24. Guide rods 40 are fixed in plates 23 and 25 while plate 24 is free to slide on the guide rods. Crank handle 26 is held in plate 25 by collars or other means but is free to rotate. One end of crank handle 26 is threaded and engaged with a threaded aperture in plate 24. The crank handle may be turned in one direction to move plate 24 closer to plate 25, thereby clamping a rifle stock in the vise. The crank handle is turned in the opposite direction to release a rifle stock from the vise. Compliant material 37 protects the rifle stock from abrasion by vertical plates 24 and 25. The compliant material is rubber or other material able to cushion a rifle stock.

A rifle butt support comprises a two-part extension, 27 and 28, a handle 29, vertical support pins, 30, and compliant material 31. Extension member 27 is attached to support plate 19 by attachment means such as welding. The total length of the two-part extension is adjustable by selecting the apertures to align when joining extension members 27 and 28. At least one pair of aligned apertures is secured using fastening means such as a bolt and nut. The compliant material is rubber or other material able to cushion a rifle butt.

A rifle is fitted into the rifle vise by firmly pushing the butt into the butt support while operating the crank handle to firmly clamp the rifle stock between vertical plates 24 and 25. The entire assembly is pointed roughly in the direction of a target and precisely aimed using pins 20 and 21. The rifle is fired and the position of the bullet hole in the target is noted.

The rifle sights (or scope) should still be aligned on the center of the target. The rifle sights (or scope) are then be adjusted to align with the hole in the target. This completes the sighting-in procedure.

Figure 7:
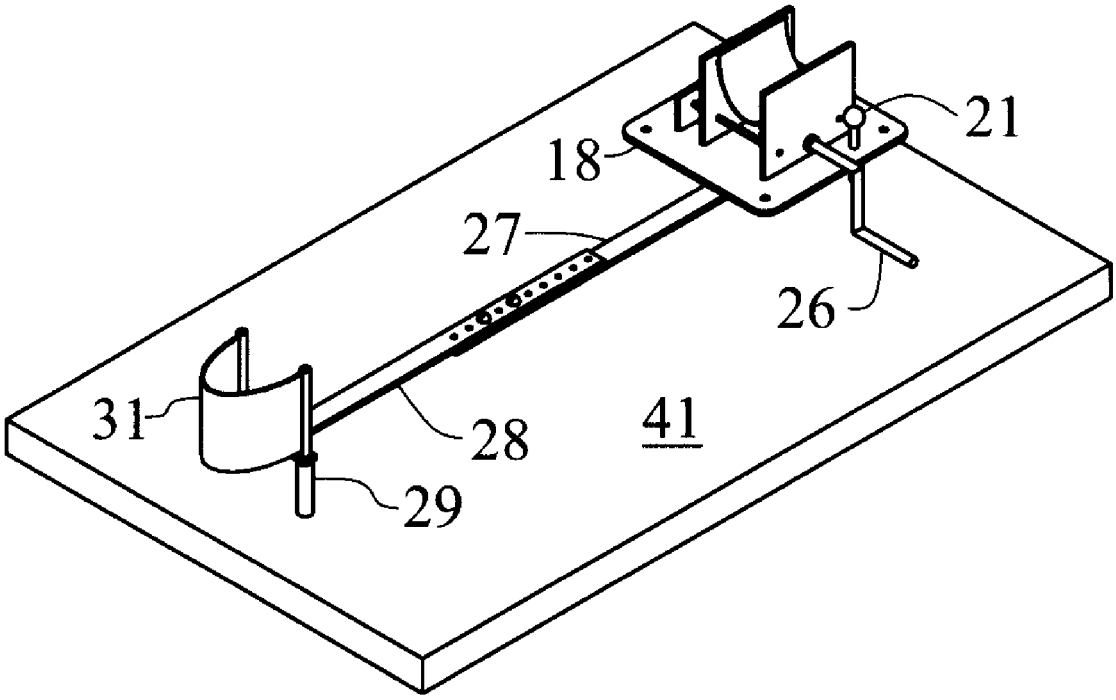
FIG. 7 is a view of the rifle vise configured on a table top.

The preferred embodiment of the present invention can be operated with the user in either a standing, sitting, or prone position. When used in the standing position, the telescoping vertical support member is adjusted so that a rifle in the vise is at eye level with a standing person. A sitting person can use the device in two configurations. In one configuration, the telescoping vertical member is adjusted to bring a rifle in the vise to eye-level for a person sitting in a chair. Alternatively, the vise assembly is removed from the telescoping vertical support member by removing pins 20, thereby releasing mounting plate 19 from support plate 18. The vise assembly is then placed on a tabletop as shown in FIG. 7 with the user seated on a chair behind the table. Handle 29 is threaded and is used in combination with pins 21 to adjust the aim of a rifle.

What is claimed is:

1. A device for supporting a rifle having a stock and a butt, the device comprising:

a stock vise, a butt support, a mounting plate, wherein said stock vice and said butt support are mounted on said mounting plate and said mounting plate has four unthreaded corner apertures and two threaded middle apertures, a support plate having an upper surface and four threaded corner apertures, two threaded middle pins engaged with the threaded apertures of said mounting plate and bearing on the upper surface of said support plate, four threaded corner pins passing through the unthreaded corner apertures of said mounting plate and engaged with the threaded corner apertures of said support plate, eight springs mounted on said four threaded corner pins, wherein one spring on each of said corner pins one is above said mounting plate and one spring is below said mounting plate, an elongated vertical support member having an upper end and a lower end, a base plate.

2. The device of claim 1 wherein said upper end of said elongated vertical support member is removably engaged with said support plate and said lower end of said elongated vertical support member is removably engaged with said base plate.

3. The device of claim 2 wherein said elongated vertical support member is a telescoping member, thereby allowing adjustment of the separation between the support plate and the base plate.

4. The device of claim 1 further comprising means for securing said base plate to the earth.

5. The device of claim 4 wherein said means for securing said base plate to the earth comprises at least one earth pin.

* * * * *